US005502858A

United States Patent [19]

Hoagland et al.

[11] Patent Number: 5,502,858

[45] Date of Patent: Apr. 2, 1996

[54] SPONGE MOP HEAD

[75] Inventors: Mary M. Hoagland, Cincinnati; Diana W. Juratovac, Columbus, both of Ohio

[73] Assignee: Vining Industries, Inc., Springfield, Ohio

[21] Appl. No.: 339,822

[22] Filed: Nov. 15, 1994

[51] Int. Cl.[6] ..... A47L 13/146

[52] U.S. Cl. ..... 15/119.2

[58] Field of Search ..... 15/116.2, 119.2, 15/244.1

[56] References Cited

U.S. PATENT DOCUMENTS

| | | | |
|---|---|---|---|
| 2,794,997 | 6/1957 | Channell | 15/119.2 |
| 2,813,287 | 11/1957 | Vaughn | 15/119.2 |
| 2,835,910 | 5/1958 | Kautenberg | 15/119.2 |
| 3,483,583 | 12/1969 | Baumgartner | 15/119.2 |

FOREIGN PATENT DOCUMENTS

| | | | |
|---|---|---|---|
| 986428 | 7/1951 | France | 15/119.2 |
| 967566 | 8/1964 | United Kingdom | 15/116.2 |

*Primary Examiner*—Edward L. Roberts, Jr.
*Attorney, Agent, or Firm*—Biebel & French

[57] ABSTRACT

A sponge mop head including a support plate for supporting a sponge and a wringer plate pivotally attached to a front edge of the support plate. A planar extension plate portion is provided extending rearwardly from the support plate such that a sponge will be substantially fully compressed between the wringer plate and the support plate and extension plate portion during a wringing operation. In addition, a handle mounting socket is provided located rearwardly of the support plate for facilitating use of the mop in low overhang areas, and to accommodate a wringer plate large enough to fully cover a compressed sponge during a wringing operation.

13 Claims, 4 Drawing Sheets

SPONGE MOP HEAD

BACKGROUND OF THE INVENTION

This invention relates to a sponge mop head, and more particularly, to a sponge mop head including a wringer which is pivotally mounted to a front edge of the mop head for wringing fluids from a sponge attached to the mop head.

Sponge mops are in wide use and typically include a sponge supporting portion for attachment to a mop handle, the sponge support portion including means for releasably receiving a sponge. In addition, such mops often include a wringer plate pivotally mounted to the support portion wherein the wringer plate may be pivoted around the support portion into contact with a sponge supported on a lower side thereof to wring out fluids contained within the sponge.

Prior art sponge mops which incorporate a wringer plate generally include a hinge located rearwardly on the support portion for pivotally mounting the wringer plate, and the wringer plate typically includes a handle and means for maintaining the wringer plate handle in engagement with the mop handle during use of the mop. Such constructions suffer from the disadvantage that if the wringer plate handle becomes loosened from the mop handle, the wringer plate will drop onto the floor and thereby interfere with the mopping operation.

In addition, many sponge mops typically include a scrub strip consisting of stiff scouring material bonded to a leading edge of the sponge, which strip is designed to extend outwardly from a leading edge of the support portion such that the scrub strip is exposed for use in scrubbing marks or difficult to remove debris using the leading edge of the mop. When the wringer plate of the prior art mop constructions is pivoted forwardly into engagement with the sponge, a front portion of the sponge may be squeezed outwardly which can cause the adhesion between the sponge and the scrub strip to be pulled apart as the sponge is rolled relative to the scrub strip. Further, a front edge of the sponge may be pushed forwardly of the leading edge of the support plate such that fluids may not be fully wrung from the front portion of the sponge.

Accordingly, there is a need for a sponge mop head which provides for improved wringing of the sponge and protection of the bonded scrub strip and which further facilitates use of such a mop.

SUMMARY OF THE INVENTION

The present invention provides a sponge mop head which facilitates wringing of the sponge and which further provides an improved configuration for facilitating use of the mop during a mopping operation.

The mop head of the present invention includes a support plate having a substantially planar sponge support surface. A lower side of the sponge support surface includes means for releasably engaging a backing plate attached to a sponge, and a plurality of downwardly extending flanges define a sponge receiving area surrounding the sponge.

A wringer plate is attached to the support plate by means of a hinge formed integrally with the support plate and wringer plate. The hinge is located at a front edge of the support plate such that the wringer plate will pivot forwardly and down around the sponge to wring the sponge.

In addition, a substantially planar extension plate portion extends rearwardly from a lower edge of the support plate, and a planar surface of the wringer plate defines an area substantially equal to an area defined by the mop receiving area and the extension plate portion. Thus, the present mop head structure is adapted to fully compress the entire area of the sponge whereby fluids in the sponge are more fully removed.

A handle mounting socket is formed integrally with and extends upwardly and rearwardly from the rear edge of the support plate. The mounting socket defines a mop handle axis which is offset rearwardly of the rear edge of the support plate. The offset of the mop handle rearwardly of the portion for supporting the sponge facilitates positioning of the mop head under projections and areas with low overhangs, and to provide sufficient area for receiving a full size wringer plate for compressing the entire area of the sponge.

Therefore, it is a general object of the present invention to provide a sponge mop head which provides for a more complete wringing of the mop.

It is another object of the invention to provide a sponge mop head including a wringer plate pivotally mounted to a forward edge of the mop head.

It is another object of the invention to provide a sponge mop head which facilitates mopping under low overhang areas and to increase the area for receiving the wringer plate.

Other objects and advantages of the invention will be apparent from the following description, the accompanying drawings and the appended claims.

DETAILED DESCRIPTION OF THE PREFERRED EMBODIMENT

Figure 1:
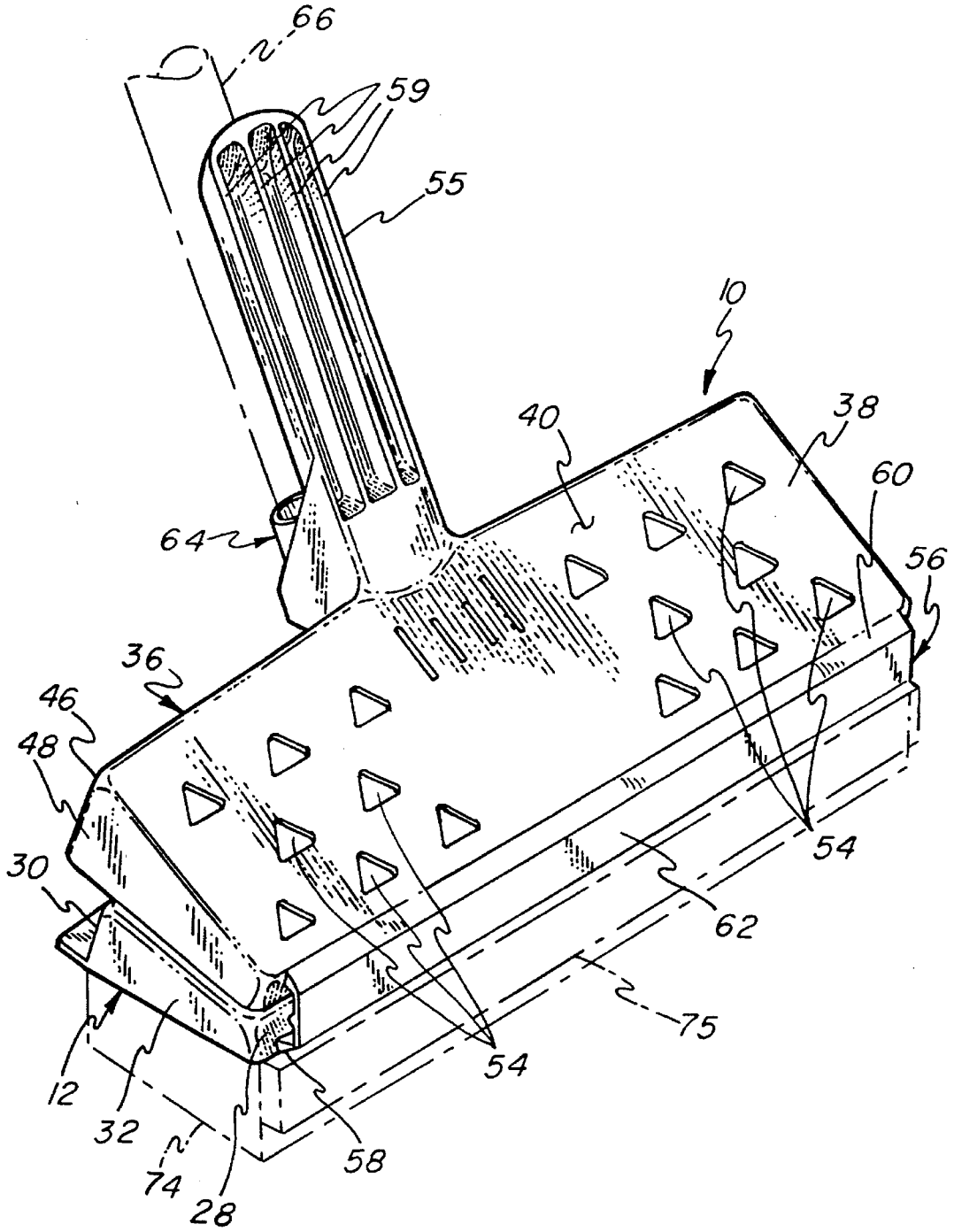
FIG. 1 is a perspective view of the sponge mop head of the present invention.
Figure 2:
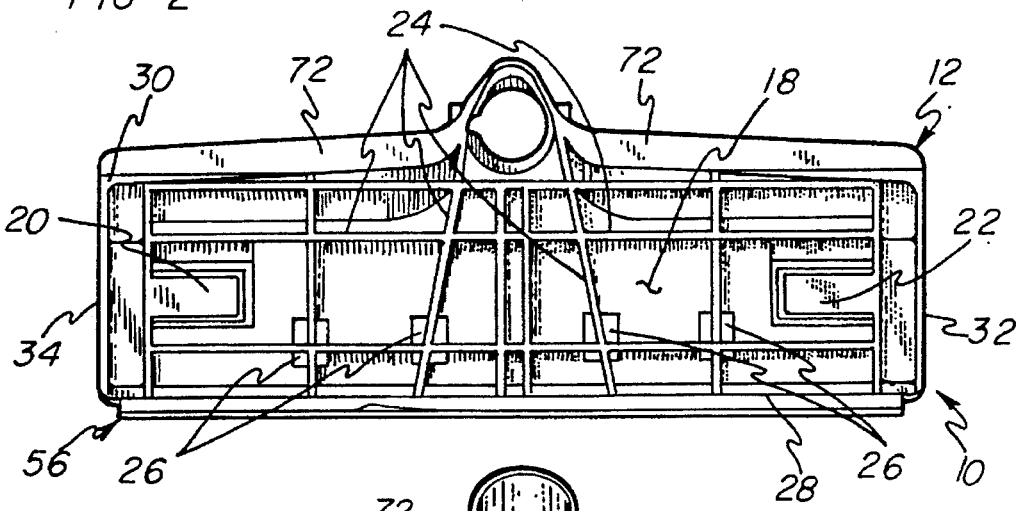
FIG. 2 is a bottom plan view of the mop head.
Figure 3:
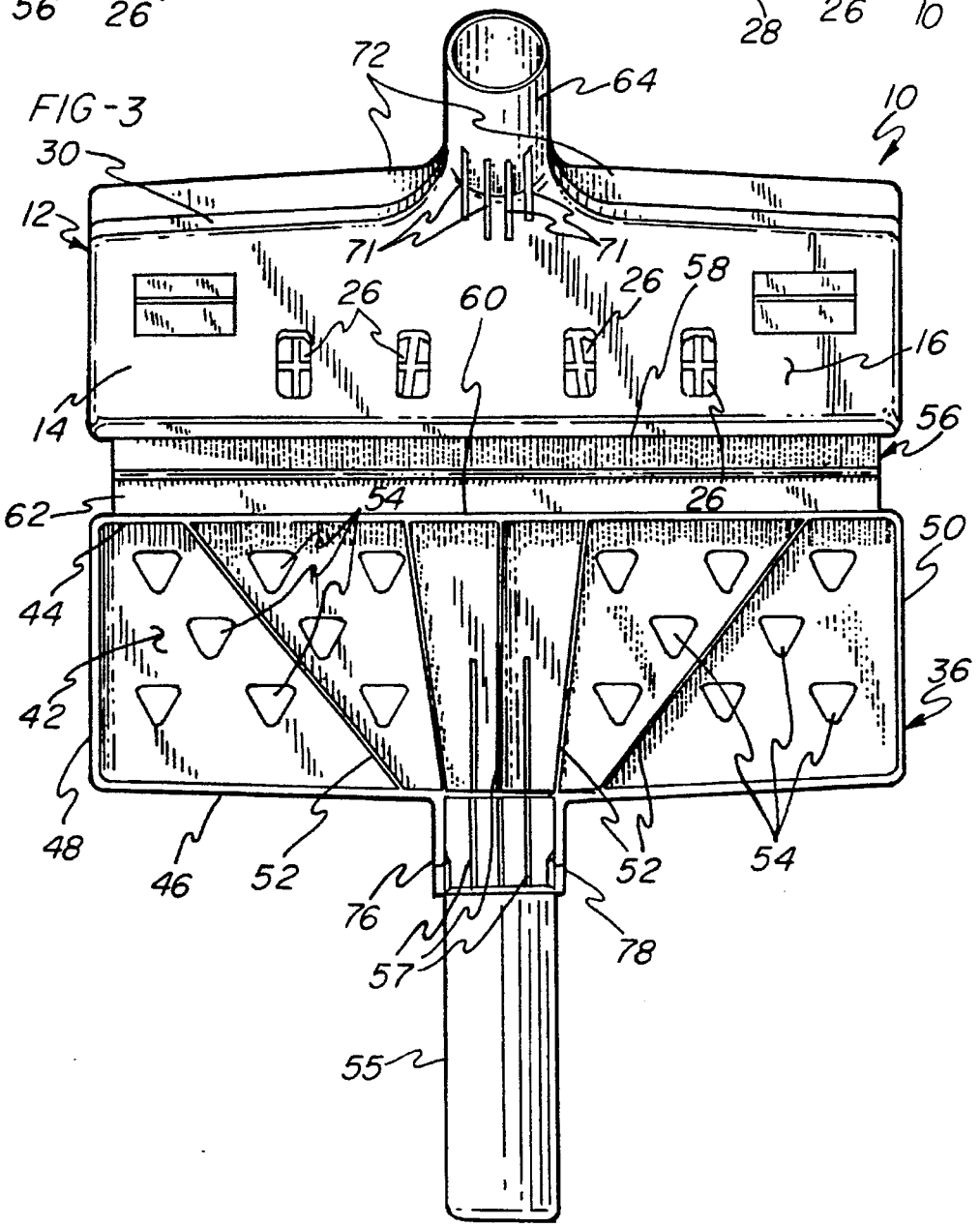
FIG. 3 is a top plan view showing the wringer plate partially pivoted away from the support plate.
Figure 4:
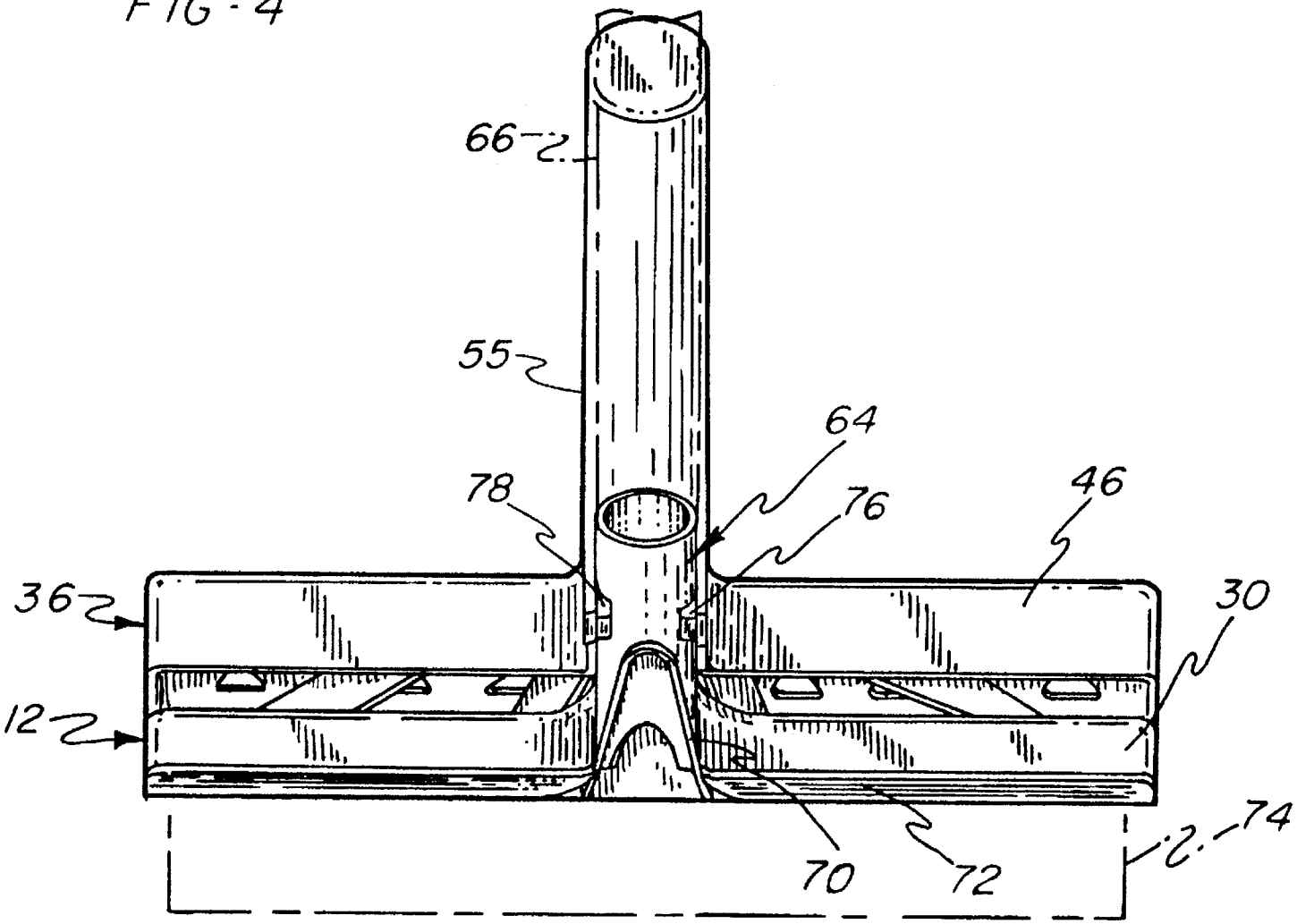
FIG. 4 is a rear elevational view.

Referring to FIGS. 1–3, the present invention provides a sponge mop head 10 which is preferably formed as an integral unit of a molded plastic material. The mop head 10 includes a support plate 12 having a substantially planar sponge support surface 14 defining upper and lower sides 16 and 18, respectively. The lower side 18 of the support plate 12 is provided with a pair of mounting tabs 20, 22 which are adapted to releasably engage within tab receiving slots formed in a backing plate (not shown) of a sponge 74 which also preferably includes a scrub strip 75. The details of the mounting of the sponge to the support plate 12 are conventional and form no part of the present invention.

The lower side 18 of the support plate 12 further includes a plurality of reinforcing ribs 24 for stiffening the support plate 12 whereby flexure of the support surface 14 is limited. The lower ends of the ribs 24 are also positioned to engage the backing plate of a sponge 74 when the sponge is locked to the mounting tabs 20, 22 whereby flexure of the sponge 74 relative to the support plate 12 is resisted. In addition, a plurality of apertures 26 are provided extending from the upper side 16 to the lower side 18 for permitting fluids to drain through the support surface 14 and thereby avoid accumulation of fluids between a sponge 74 and the lower side 18 of the support plate 12.

The support plate 12 also includes a front flange portion 28, a rear flange portion 30, a right side flange portion 32 and a left side flange portion 34. The flange portions 28, 30, 32, 34, in combination with the lower surfaces of the ribs 24, define a sponge receiving area below the lower side 18, and the front and rear flange portions 28, 30 define front and rear edges, respectively, of the support plate 12.

As may be further seen in FIGS. 1 and 3, the mop head 10 further includes a wringer plate 36 having a substantially planar portion 38 defining first and second sides 40, 42, respectively. The wringer plate 36 includes a front edge flange 44, a rear edge flange 46, a right side edge flange 48 and a left side edge flange 50. In addition, a plurality of stiffening ribs 52 are provided extending along the second side 42 to keep the plate 36 flat, and a plurality of apertures 54 are provided extending from the first side 40 to the second side 42 for permitting fluids to flow through the wringer plate 36 during a wringing operation.

The wringer plate 36 is pivotally connected to the support plate 12 by a hinge 56 which is formed integrally with the support plate 12 and the wringer plate 36. The hinge 56 includes a first pivot joint 58 adjacent to the front edge of the support plate 12 and located on a surface contour at the front flange 28 and a second pivot joint 60 located on a surface contour extending from the planar portion 38 adjacent to the front flange 44. A narrow connector strip 62 extends between the first and second pivot joints 58, 60 to facilitate movement of the wringer plate 36 around the support plate 12.

A wringer handle 55 extends upwardly and rearwardly from the rear edge flange 46 of the wringer plate 36 for pivoting the wringer plate 36 about the support plate 12. A plurality of spaced reinforcing ribs 57 are provided extending from a lower side of the wringer handle 55 to the second side 42 of the wringer plate 36. In addition, the handle 55 is provided with a plurality of ribs 59 which stiffen the handle 55 to ensure that the handle 55 provides a good wringing action with minimal flexing.

Referring to FIGS. 3–6 a handle mounting socket 64 is formed integrally with and extends upwardly and rearwardly from the rear support plate edge defined by the rear flange portion 30. In addition, the mop handle axis 68 is angled rearwardly to place the mop handle 66 in a comfortable position relative to the mop head 10 during a mopping operation. The socket 64 preferably includes a threaded interior portion for rotatably receiving a mop handle 66 and defines a mop handle axis 68 which is offset rearwardly of the rear flange portion 30. Thus, substantially the entire support plate 12 and an associated sponge attached thereto will be located forwardly of a handle 66 attached to the support plate 12 whereby positioning of he mop head 10 under low overhang surfaces is facilitated. It should be noted that the mounting socket 64 is further provided with means defining a substantially planar abutment surface 70 on a rear side of the socket 64. The abutment surface 70 defines a plane extending at a small acute angle relative to the mop handle axis 68 and is adapted to engage a lower portion of the ringer handle 55 during a wringing operation to thereby limit pivotal movement of the handle 55 and further to avoid undue stress from being transferred to the joint between the mounting socket 64 and the support plate 12. The joint between the handle mounting socket 64 and the support plate 12 is provided with reinforcing ribs 71 to further strengthen the joint area.

Figure 5:
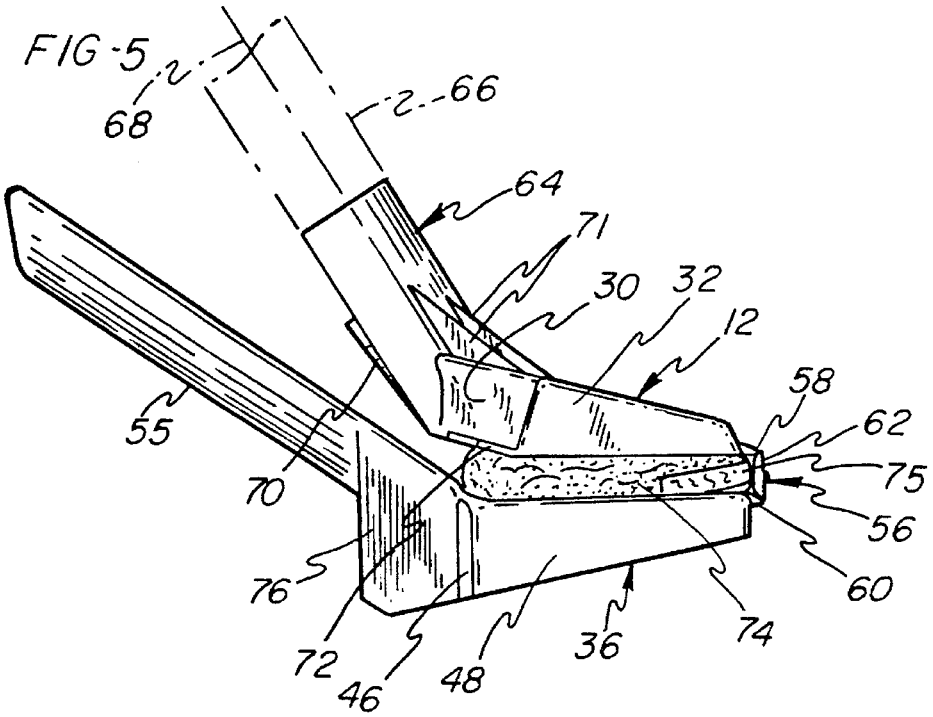
FIG. 5 is a right side elevational view showing the wringer plate in position for wringing a sponge.

Referring to FIGS. 2, 3 and 5, a substantially planar extension plate portion 72 extends rearwardly from the rear flange portion 30 of the support plate 12. As seen in plan view, the planar first surface 40 of the wringer plate 36 defines an area substantially equal to a combined area defined by the mop receiving area under the lower side 18, and the extension plate portion 72. As seen in FIG. 5, it should be apparent that this construction insures that substantially the entire body of a sponge 74 mounted to the support plate 12 is compressed between the support plate 12 and the wringer plate 36. Further, it should be apparent that this compression takes place even though a portion of the sponge 74 may be pushed rearwardly of the sponge receiving area during a wringing operation.

As may be further seen in FIG. 5, the hinge structure 56 facilitates protection of the bonded joint between the scrub strip 75 and the sponge 74. Specifically, as the wringer plate 36 moves around the support plate 12 during a wringing operation, a leading portion of the planar portion 38 will engage the scrub strip 75 and cause it to pivot rearwardly, further facilitating wringing of the sponge 74. In addition, it should be noted that the connector strip 62 is generally in engagement with an upper edge of the scrub strip 75 during the pivoting of the wringer plate 36. This configuration of the pivot for the wringer plate 36 ensures that the scrub strip 75 will pivot around with the portion of the sponge 74 to which it is bonded thereby avoiding separation of the scrub strip 75 from the sponge 74, as well as facilitating compression of the leading edge of the sponge 74.

Referring to FIG. 3, it should be noted that a pair of locking ears 76, 78 are provided extending rearwardly along the wringer handle 55 from the rear flange 46 of the wringer plate 36. The locking ears 76, 78 define a U-shaped recess for receiving the handle mounting socket 64 in frictional engagement whereby the wringer plate 36 may be maintained in position on top of the support plate 12 when the wringer plate 36 is not in use.

Figure 6:
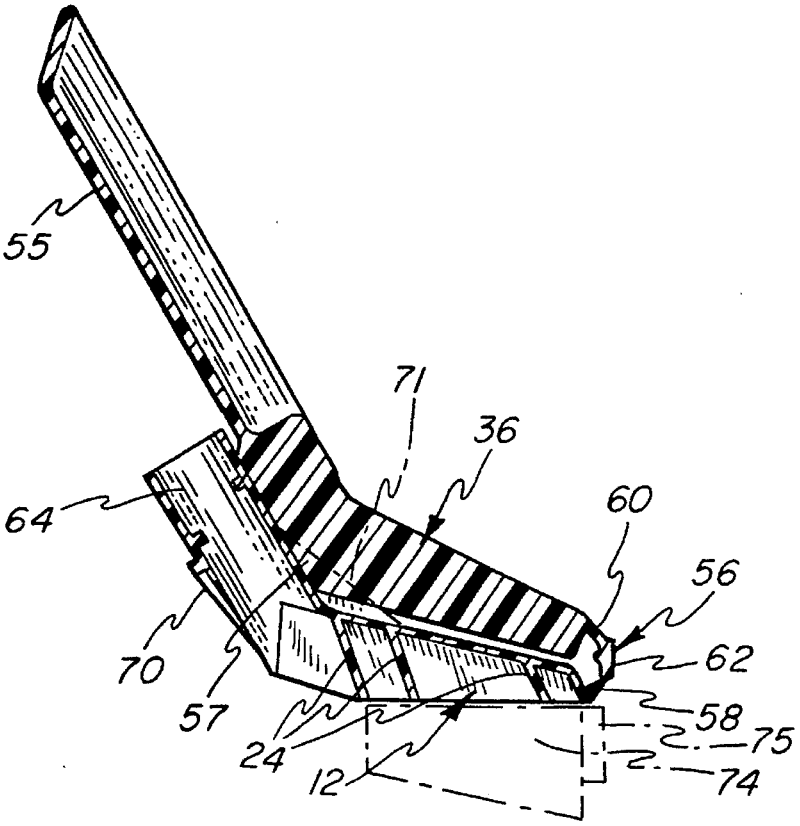
FIG. 6 is a right side elevational cut-away view through the center of the mop head.

Referring to FIG. 6, it should be noted that by positioning the mounting socket 64 rearwardly of the support plate 12, additional space is provided for receiving the wringer plate 36 on top of the support plate 12 whereby a sufficient extension of the wringer plate 36 in the front to rear direction is provided for fully engaging the sponge 74 during a wringing operation. In addition, it should be noted that the reinforcing ribs 57 of the wringer plate 36 are located to be positioned in between the reinforcing ribs 71 of the support plate 12 to thereby further provide a maximum available area in the front to rear direction for the wringer plate 36.

From the above description, it should be apparent that the present invention provides a mop head which facilitates complete wringing of fluids from a sponge attached to the mop head. In addition, it should be apparent that this is accomplished by providing the mop head with a wringer plate pivotally attached to a front portion of the mop head. In a rest or non-use condition, the wringer plate is positioned on top of the mop head such that the wringer plate will be inhibited from falling on the floor surface if it should become loosened from its rest position.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A sponge mop head comprising:

a support plate having a substantially planar upper side and a lower side, and front and rear edges;

a substantially planar wringer plate having a front edge and a rear edge;

a hinge extending between said front edge of said support plate and said front edge of said wringer plate for pivotally connecting said wringer plate to said support plate;

a handle mounting socket on said support plate located adjacent to said rear edge of said support plate for receiving a mop handle extending rearwardly from said support plate; and wherein said wringer plate is pivotable around the from edge of said support plate from a position substantially flat on top of said support plate with said rear edge of said wringer plate adjacent to said rear edge of said support plate to a position substantially flat across the lower side of said support plate with said rear edge of said wringer plate adjacent to said rear edge of said support plate whereby said wringer plate engages and wrings a sponge mounted to said lower side.

2. The mop head as recited in claim 1 wherein said hinge is formed integrally with said support plate and said wringer plate.

3. The mop head as recited in claim 2 wherein said hinge includes a first pivot joint, a second pivot joint and a connecting strip extending between said first and second joints.

4. The mop head as recited in claim 1 wherein said handle mounting socket defines a mop handle axis offset rearwardly of said rear edge of said support plate.

5. The mop head as recited in claim 4 wherein said handle mounting socket is formed integrally with said support plate.

6. The mop head as recited in claim 1 including an extension plate portion extending rearwardly of and substantially perpendicular to said rear edge of said support plate, said extension plate cooperating with said wringer plate to squeeze a sponge mounted to said support plate.

7. The mop head as recited in claim 6 wherein said support plate defines a sponge receiving area, said sponge receiving area and said support plate extension portion defining an area substantially equal to a planar area of said wringer plate.

8. The mop head as recited in claim 1 wherein said wringer plate includes opposing first and second sides, said first side being substantially planar for engaging a sponge mounted to said support plate and said second side including reinforcing ribs.

9. A sponge mop head comprising:

a support plate having upper and lower sides and front and rear edges;

a sponge receiving area defined on said lower side between said front and rear edges;

a wringer plate having a front edge and a rear edge;

a hinge extending between said front edge of said support plate and said front edge of said wringer plate for pivotally connecting said wringer plate to said support plate;

a handle mounting socket on said support plate for receiving a mop handle extending upwardly and rearwardly from said support plate;

an extension plate portion extending rearwardly from said rear edge of said support plate, said extension plate cooperating with said wringer plate to squeeze a sponge mounted to said support plate; and wherein said wringer plate is pivotable at said hinge from a position substantially flat on top of said support plate with said rear edge of said wringer plate adjacent to said rear edge of said support plate to a position substantially flat across the lower side of said support plate with said rear edge of said wringer plate adjacent to said rear edge of said support plate.

10. The mop head as recited in claim 9 wherein said hinge is formed integrally with said front edge of said support plate.

11. The mop head as recited in claim 9 wherein said handle mounting socket is formed integrally with said support plate and defines a mop handle axis offset rearwardly of said rear edge of said support plate.

12. The mop head as recited in claim 9 wherein said wringer plate includes a substantially planar surface for engaging a sponge mounted in said sponge receiving area, said substantially planar surface of said wringer plate defining an area substantially equal to an area defined by said sponge receiving area and said extension plate portion.

13. A sponge mop head comprising:

a support plate including a substantially planar sponge support surface defining upper and lower sides and apertures extending between said upper and lower sides, said support plate further including front, rear and side flange portions extending downwardly from said sponge support surface and defining front, rear and side support plate edges surrounding a sponge receiving area;

a wringer plate including a planar surface with apertures formed therethrough, said wringer plate having front and rear edges and a wringer handle extending upwardly and rearwardly from said rear edge;

a hinge formed integrally with said support plate and said wringer plate for pivotally connecting said wringer plate to said support plate, said hinge including a first pivot joint adjacent to said front edge of said support plate, a second pivot joint adjacent to said wringer plate and a narrow connector strip extending between said first and second pivot joints;

a handle mounting socket formed integrally with and extending upwardly and rearwardly from said rear support plate edge, said socket defining a mop handle axis offset rearwardly of said rear flange portion;

means defining a substantially planar abutment surface on a lower rear portion of said handle mounting socket for engaging a lower front portion of said wringer handle during a wringing operation;

a pair of locking ears extending rearwardly from said wringer plate adjacent to said wringer handle and defining a U-shaped recess for receiving said handle mounting socket to maintain said wringer plate in position on top of said support plate; and a substantially planar extension plate portion extending rearwardly from said rear flange portion, said planar surface of said wringer plate defining an area substantially equal to an area defined by said sponge receiving area and said extension plate portion.

* * * * *

UNITED STATES PATENT AND TRADEMARK OFFICE

CERTIFICATE OF CORRECTION

PATENT NO. : 5,502,858

DATED : April 2, 1996

INVENTOR(S) : Mary M. Hoagland and Diana W. Juratovac

It is certified that error appears in the above-indentified patent and that said Letters Patent is hereby corrected as shown below:

Column 5,
In Claim 1, line 11, delete "from" and insert --front--.

Signed and Sealed this

Second Day of July, 1996

*Attest:*

Bruce Lehman

BRUCE LEHMAN

*Attesting Officer*

*Commissioner of Patents and Trademarks*